US010184472B2

(12) United States Patent
Ryu et al.

(10) Patent No.: US 10,184,472 B2
(45) Date of Patent: Jan. 22, 2019

(54) SCROLL COMPRESSOR AND AIR CONDITIONER INCLUDING A SCROLL COMPRESSOR

(71) Applicant: LG ELECTRONICS INC., Seoul (KR)

(72) Inventors: Byoungjin Ryu, Seoul (KR); Younghwan Ko, Seoul (KR); Byeongsu Kim, Seoul (KR); Beomchan Kim, Seoul (KR); Baikyoung Chung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 298 days.

(21) Appl. No.: 14/988,105

(22) Filed: Jan. 5, 2016

(65) Prior Publication Data

US 2016/0201669 A1 Jul. 14, 2016

(30) Foreign Application Priority Data

Jan. 12, 2015 (KR) ..... 10-2015-0004226

(51) Int. Cl.
*F04C 18/02* (2006.01)
*F04C 29/00* (2006.01)

(52) U.S. Cl.
CPC ..... *F04C 18/0261* (2013.01); *F04C 18/0215* (2013.01); *F04C 29/0007* (2013.01); *F04C 29/0085* (2013.01)

(58) Field of Classification Search
CPC ..... F04C 18/0261; F04C 18/0215; F04C 29/0007; F04C 29/0085
(Continued)

(56) References Cited

U.S. PATENT DOCUMENTS

2002/0050149 A1 5/2002 Kawada
2004/0035122 A1* 2/2004 Lifson ..... F25B 1/047 62/113

(Continued)

FOREIGN PATENT DOCUMENTS

CN 101523130 9/2009
CN 102062497 5/2011

(Continued)

OTHER PUBLICATIONS

Korean Notice of Allowance dated Feb. 8, 2017 issued in Application No. 10-2015-0004226.

(Continued)

*Primary Examiner* — Phutthiwat Wongwian
*Assistant Examiner* — Kelsey Stanek
(74) *Attorney, Agent, or Firm* — KED & Associates, LLP

(57) ABSTRACT

A scroll compressor and an air conditioner including a scroll compressor are provided. The scroll compressor may include a main frame configured to support an upper portion of a rotating shaft; a fixed scroll coupled to the main frame and having a first wrap; an orbiting scroll provided to perform an orbiting motion with respect to the fixed scroll and having a second wrap which forms a plurality of compressions chamber between the first wrap and the second wrap; a suction port configured to enable a first refrigerant to be suctioned into the compression chamber; a first introduction port provided at a first side of the fixed scroll and configured to inject the first refrigerant into the plurality of compression chambers; a second introduction port provided at a second side of the fixed scroll and configured to inject a second refrigerant having a pressure different from a pressure of the first refrigerant into the plurality of compression chambers; and a third introduction port provided at a third side of the fixed scroll and configured to inject a third (Continued)

refrigerant having a pressure different from the pressure of the first refrigerant and the second refrigerant into the compression chamber. The first introduction port may be provided at a position at which injecting of the refrigerant through the first introduction port is able to be performed before suctioning of the refrigerant through the suction port is completed.

26 Claims, 8 Drawing Sheets

(58) Field of Classification Search
USPC ..... 418/55.1; 62/190, 513, 512
See application file for complete search history.

(56) References Cited

U.S. PATENT DOCUMENTS

| | | | | |
|---|---|---|---|---|
| 2008/0078192 | A1 | 4/2008 | Ignatiev et al. | |
| 2008/0236179 | A1* | 10/2008 | Ignatiev | F25B 1/10 62/190 |
| 2013/0081424 | A1* | 4/2013 | Jang | F04C 18/0292 62/498 |

FOREIGN PATENT DOCUMENTS

| | | | | |
|---|---|---|---|---|
| CN | 103032321 | | 4/2013 | |
| EP | 2 578 885 | | 4/2013 | |
| JP | H 09-256974 | | 9/1997 | |
| JP | 2013-227873 | | 11/2013 | |
| KR | 10-2011-034865 | | 4/2011 | |
| KR | 10-1280381 | B1 | 7/2013 | |
| KR | 10-2014-0017817 | | 2/2014 | |
| KR | 10-1382007 | | 4/2014 | |
| KR | 101382007 | B1 * | 4/2014 | F04C 29/0007 |
| WO | WO 2008/042358 | | 4/2008 | |

OTHER PUBLICATIONS

Chinese Office Action dated Jul. 17, 2017 issued in Application No. 201510968328.7 (with English translation).
European Search Report dated May 12, 2016 issued in Application No. 16150595.3.
Korean Office Action dated Jul. 7, 2016 issued in Application No. 10-2015-0004226.

* cited by examiner

SCROLL COMPRESSOR AND AIR CONDITIONER INCLUDING A SCROLL COMPRESSOR

CROSS-REFERENCE TO RELATED APPLICATION(S)

This application claims priority under 35 U.S.C. § 119 to Korean Patent Application No. 10-2015-0004226, filed in Korea on Jan. 12, 2015, the content of which is hereby incorporated by reference in its entirety.

BACKGROUND

1. Field

A scroll compressor and an air conditioner including a scroll compressor are disclosed herein.

2. Background

An air conditioner is a home appliance that maintains indoor air in an optimal state according to uses and purposes thereof. For example, an indoor space may be controlled to a cooling state in summer, and controlled to a warming state in winter. Indoor humidity may also be controlled, and the indoor air may be maintained in a fresh and clean state.

The air conditioner may be driven in a refrigeration cycle in which compression, condensation, expansion and evaporation processes of a refrigerant may be performed, and thus, a cooling or warming operation of the indoor space may be performed. According to whether an indoor unit or device and an outdoor unit or device are separated or integrated, the air conditioner may be classified into a separated type air conditioner, in which the indoor device and the outdoor device are separated from each other, or an integrated type air conditioner, in which the indoor device and the outdoor device may be integrated in one device.

The outdoor device may include an outdoor heat exchanger which may perform heat-exchange with external air, and the indoor device may include an indoor heat exchanger which may perform heat-exchange with indoor air. The air conditioner may be switched into a cooling mode and a warming mode, and may be operated in a switched mode. When the air conditioner is operated in the cooling mode, the outdoor heat exchanger may serve as a condenser, and the indoor heat exchanger may serve as an evaporator. When the air conditioner is operated in the warming mode, the outdoor heat exchanger may serve as the evaporator, and the indoor heat exchanger may serve as the condenser.

In general, when ambient air conditions are not good, a cooling or warming performance of the air conditioner may be restricted. For example, when a temperature of the ambient air is very high or low at an installation area of the air conditioner, a sufficient flow rate of a refrigerant is required to obtain a desired cooling or warming performance. A compressor having a large capacity may be provided to increase a performance of the compressor. In this case, a manufacturing or installation cost of the air conditioner may be increased.

To solve the above problem, Applicants filed an application for a patent on a heat pump system in which a refrigerant is injected into a scroll compressor using a refrigerant injection path, which was issued as Korea Patent No. 10-1280381, entitled "Heat Pump", hereinafter, referred to as a "related art patent", and hereby incorporated by reference.

However, in the case of the above-described related art patent, only first and second refrigerant injection ports are provided and that refrigerant injection may be performed is disclosed, and a relative position between an injection hole formed at a compressor and an inlet port (a refrigerant suction port) of the compressor is not specified. A relative position of the injection hole with respect to the inlet port may have a large influence on whether a flow rate of a suctioned or injected refrigerant is able to be increased.

For example, when the injection hole is located at a predetermined position, an injection of the refrigerant may be performed before suction of the refrigerant into the scroll compressor is completed, and there may be a problem that a pressure in a suction chamber may be increased, and thus, the flow rate of the suctioned refrigerant in the compressor may be reduced. As another example, when the injection hole is located at another predetermined position, injection of the refrigerant may be performed after the suction of the refrigerant into the scroll compressor is completed, the injection may be performed after an internal pressure of a compression chamber is already increased, and thus, an injection flow rate may be reduced. Therefore, the position of the injection hole formed at the scroll compressor may have a large influence on improvement of performance of the compressor or the air conditioner.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. However, the technical spirit is not restricted or limited thereto, and the embodiments may be modified by a person with ordinary skill in the art to variously perform.

Figure 1:
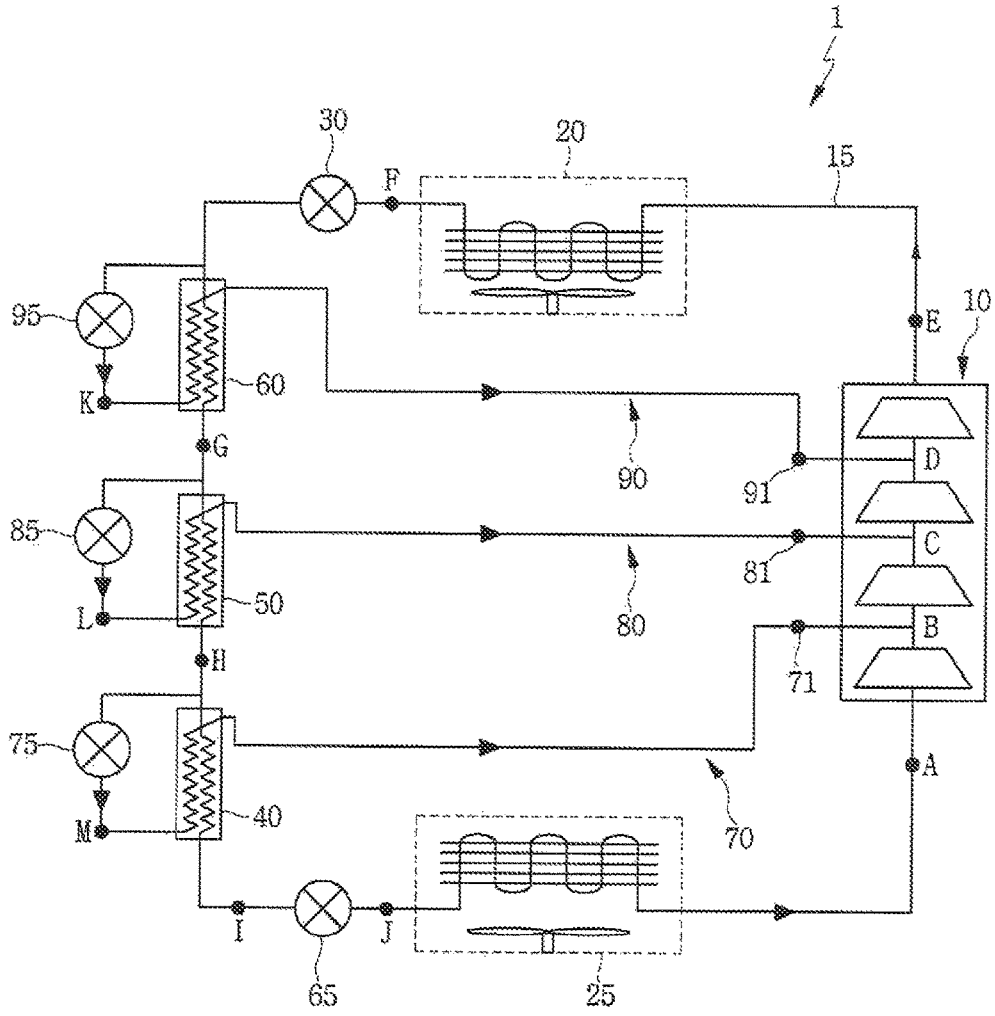
FIG. 1 is a schematic diagram of an air conditioner in accordance with an embodiment.
Figure 2:
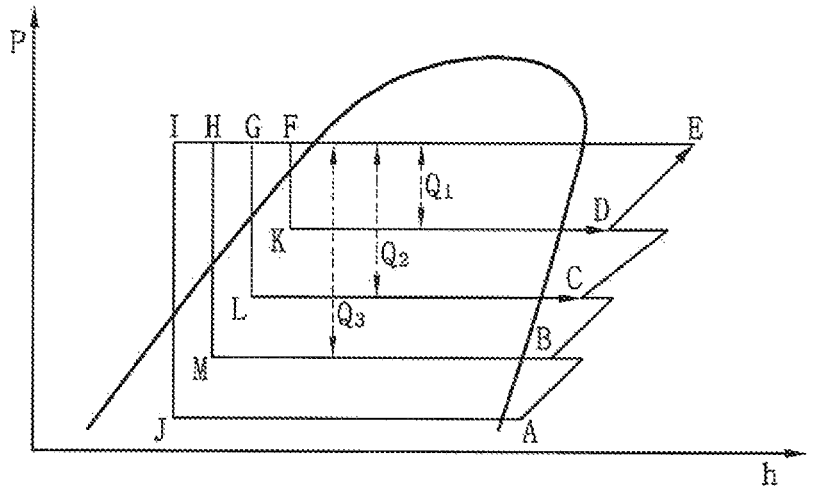
FIG. 2 is a P-H diagram illustrating a change in properties of a refrigerant according to an operation of the air conditioner in accordance with an embodiment.

FIG. 1 is a schematic diagram of an air conditioner in accordance with an embodiment. FIG. 2 is a P-H diagram illustrating a change in properties of a refrigerant according to an operation of the air conditioner in accordance with an embodiment. Referring to FIGS. 1 and 2, in an air conditioner 1 in accordance with an embodiment, a refrigeration cycle in which a refrigerant is circulated may be driven. The air conditioner 1 may perform a cooling or warming operation according to a circulation direction of the refrigerant.

The air conditioner 1 may include a compressor 10, which may compress the refrigerant, a condenser 20, which may condense the refrigerant compressed in the compressor 10, a first expander 30 and a second expander 65, which may selectively expand the refrigerant condensed in the condenser 20, an evaporator 25, which may evaporate the refrigerant passed through the first and second expanders 30 and 65, and a refrigerant pipe 15, which may connect the above-described components with each other and guide a flow of the refrigerant. When the air conditioner 1 performs the cooling operation, an outdoor heat exchanger may serve as the condenser, and an indoor heat exchanger may serve as the evaporator. However, when the air conditioner 1 performs the warming operation, the indoor heat exchanger may serve as the condenser, and the outdoor heat exchanger may serve as the evaporator.

The compressor 10 may be configured to perform a multistage compression, and may be a scroll compressor in which the refrigerant may be compressed by a relative phase difference between a fixed scroll and an orbiting scroll. Description thereof will be described hereinafter.

The air conditioner 1 may include a plurality of supercoolers 40, 50 and 60, which may supercool the refrigerant passed through the condenser 20. The plurality of supercoolers 40, 50 and 60 may include a third supercooler 60, which may supercool the refrigerant passed through the first expander 30, a second supercooler 50, which may supercool the refrigerant passed through the third supercooler 60, and a first supercooler 40 which may supercool the refrigerant passed through the second supercooler 50. The refrigerant discharged from the condenser 20 may not expand while passing through the first expander 30.

The air conditioner 1 may include a third injection path 90, which may enable at least a portion of the refrigerant passed through the first expander 30 to bypass the second expander 65 and the evaporator 25, and a third injection expander 95, which may be provided at or in the third injection path 90 to control an amount of the bypassed refrigerant. The refrigerant may expand while passing through the third injection expander 95.

The bypassed refrigerant of the refrigerant passed through the first expander 30 may be referred to as a "first branched refrigerant", and the remaining refrigerant except the branched refrigerant may be referred to as a "main refrigerant". In the third supercooler 60, the main refrigerant may perform a heat-exchange with the first branched refrigerant.

The first branched refrigerant may be changed into a low temperature and low pressure refrigerant while passing through the third injection expander 95, and thus, may absorb heat while performing a heat-exchange with the main refrigerant, and the main refrigerant may transmit heat to the first branched refrigerant. Therefore, the main refrigerant may be supercooled. The first branched refrigerant passed through the third supercooler 60 may be injected into the compressor 10 through the third injection path 90. The third injection path 90 may include a third injection introduction port 91 which injects the refrigerant into the compressor 10. The third injection introduction port 91 may be connected to a first position of the compressor 10.

The air conditioner 1 may include a second injection path 80, which may enable at least a portion of the main refrigerant passed through the third supercooler 60 to bypass the second expander 65 and the evaporator 25, and a second injection expander 85, which may be provided at or in the second injection path 80 to control an amount of the bypassed refrigerant. The refrigerant may expand while passing through the second injection expander 85. The refrigerant bypassed to the second injection path 80 may be referred to as a "second branched refrigerant". In the second supercooler 50, the main refrigerant may perform a heat-exchange with the second branched refrigerant.

The second branched refrigerant may be changed into a low temperature and low pressure refrigerant while passing through the second injection expander 85, and thus, may absorb heat while performing a heat-exchange with the main refrigerant, and the main refrigerant may transmit heat to the second branched refrigerant. Therefore, the main refrigerant may be supercooled. The second branched refrigerant passed through the second supercooler 50 may be injected into the compressor 10 through the second injection path 80.

The second injection path 80 may include a second injection introduction port 81, which may inject the refrigerant into the compressor 10. The second injection introduction port 81 may be connected to a second position of the compressor 10. That is, the second injection introduction port 81 and the third injection introduction port 91 may be connected to different positions of the compressor 10, respectively.

The air conditioner 1 may include a first injection path 70, which may enable at least a portion of the main refrigerant passed through the second supercooler 50 to bypass the second expander 65 and the evaporator 25, and a first injection expander 75 that may be provided at or in the first injection path 70 to control an amount of the bypassed refrigerant. The refrigerant may expand while passing through the first injection expander 75. The refrigerant bypassed to the first injection path 70 may be referred to as a "third branched refrigerant". In the first supercooler 40, the main refrigerant may be heat-exchanged with the third branched refrigerant.

The third branched refrigerant may be changed into a low temperature and low pressure refrigerant, while passing through the first injection expander 75, and thus, may absorb heat while performing a heat-exchange with the main refrigerant, and the main refrigerant may transmit heat to the third branched refrigerant. Therefore, the main refrigerant may be supercooled. The third branched refrigerant passed through the first supercooler 40 may be injected into the compressor 10 through the first injection path 70.

The first injection path 70 may include a first injection introduction port 71, which may inject the refrigerant into the compressor 10. The first injection introduction port 71 may be connected to a third position of the compressor 10. That is, the first injection introduction port 71 may be connected to the compressor 10 at a position different from the positions of the second injection introduction port 81 and the third injection introduction port 91. The refrigerant passed through the first supercooler 40 may expand while passing through the second expander 65, may be introduced into the evaporator 25, evaporated in the evaporator 25, and then suctioned into a suction port of the compressor 10.

With reference to FIGS. 1 and 2, a P-H (pressure-enthalpy) diagram of a refrigerant system which is circulated in the air conditioner will be described. The refrigerant (in an A state) suctioned into the compressor 10 may be compressed in the compressor 10, and mixed with the refrigerant injected into the compressor 10 through the first injection path 70. The mixed refrigerant may be in a B state. A process by which the refrigerant may be compressed from the A state to the B state may be referred to as a "first stage compression".

The refrigerant in the B state may be compressed again, and the compressed refrigerant may be mixed with the refrigerant injected into the compressor 10 through the second injection path 80. The mixed refrigerant may be in a C state. A process by which the refrigerant may be compressed from the B state to the C state may be referred to as a "second stage compression".

The refrigerant in the C state may be compressed again, and the compressed refrigerant may be mixed with the refrigerant injected into the compressor 10 through the third injection path 90. The mixed refrigerant may be in a D state. A process by which the refrigerant may be compressed from the C state to the D state may be referred to as a "third stage compression".

The refrigerant in the D state may be compressed again, and the compressed refrigerant may be in an E state. A process by which the refrigerant may be compressed from the D state to the E state may be referred to as a "fourth stage compression". The refrigerant in the E state may be introduced into the condenser 20, and the refrigerant discharged from the condenser 20 may be in an F state.

The refrigerant (the first branched refrigerant) of the refrigerant passed through the condenser 20, which is bypassed and passes through the third injection expander 95, may expand to a K state, and may be heat-exchanged with the main refrigerant in an F state. In this process, the main refrigerant in the F state may be supercooled to a G state, and the first branched refrigerant in the K state may be injected into the compressor 10, mixed with a refrigerant in the compressor 10, and may be in the D state.

The refrigerant (the second branched refrigerant) of the main refrigerant (in the G state) passed through the third supercooler 60, which is bypassed and passes through the second injection expander 85, may be expanded to an L state, and may be heat-exchanged with the main refrigerant. In this process, the main refrigerant in the G state may be supercooled to an H state, and the second branched refrigerant in the L state may be injected into the compressor 10, mixed with the refrigerant in the compressor 10, and may be in the C state.

The refrigerant (the third branched refrigerant) of the main refrigerant supercooled to the H state, which is bypassed and passes through the first injection expander 75, may be expanded to an M state, and may be heat-exchanged with the main refrigerant. In this process, the main refrigerant in the H state may be supercooled to an I state, and the third branched refrigerant in the M state may be injected into the compressor 10, mixed with the refrigerant in the compressor 10, and may be in the B state. The main refrigerant in the I state may be expanded in the second expander 65 to a J state, and may be introduced into the evaporator 25. The refrigerant heat-exchanged in the evaporator 25 may be in the A state, and may be introduced into the compressor 10.

A pressure at the line that connects E and I may be referred to as a "high pressure". A pressure at the line that connects D and K, that is, a pressure in the third injection path 90 may be referred to as a "third intermediate pressure"; a pressure at the line that connects C and L, that is, a pressure in the second injection path 80 may be referred to as a "second intermediate pressure"; and a pressure at the line that connects B and M, that is, a pressure in the first injection path 70 may be referred to as a "first intermediate pressure". A pressure at the line that connects A and J may be referred to as a "low pressure". The pressure may satisfy the following relation: high pressure>third intermediate pressure>second intermediate pressure>first intermediate pressure>low pressure.

A flow rate Q1, which may be injected into the compressor 10 through the third injection path 90 may be proportional to a pressure difference between the high pressure and the third intermediate pressure, and a flow rate Q2, which may be injected into the compressor 10 through the second injection path 80 may be proportional to a pressure difference between the high pressure and the second intermediate pressure. A flow rate Q3, which may be injected into the compressor 10 through the first injection path 70 may be proportional to a pressure difference between the high pressure and the first intermediate pressure. Therefore, as the first intermediate pressure, the second intermediate pressure or the third intermediate pressure, may be formed at a lower pressure side, the flow rate which may be injected into the compressor 10 may be increased. For example, a flow rate of the first branched refrigerant through the first injection path 70 may be greater than a flow rate of the second branched refrigerant through the second injection path, which may be greater than a flow rate of the third branched refrigerant through the third injection path 90.

Figure 3:
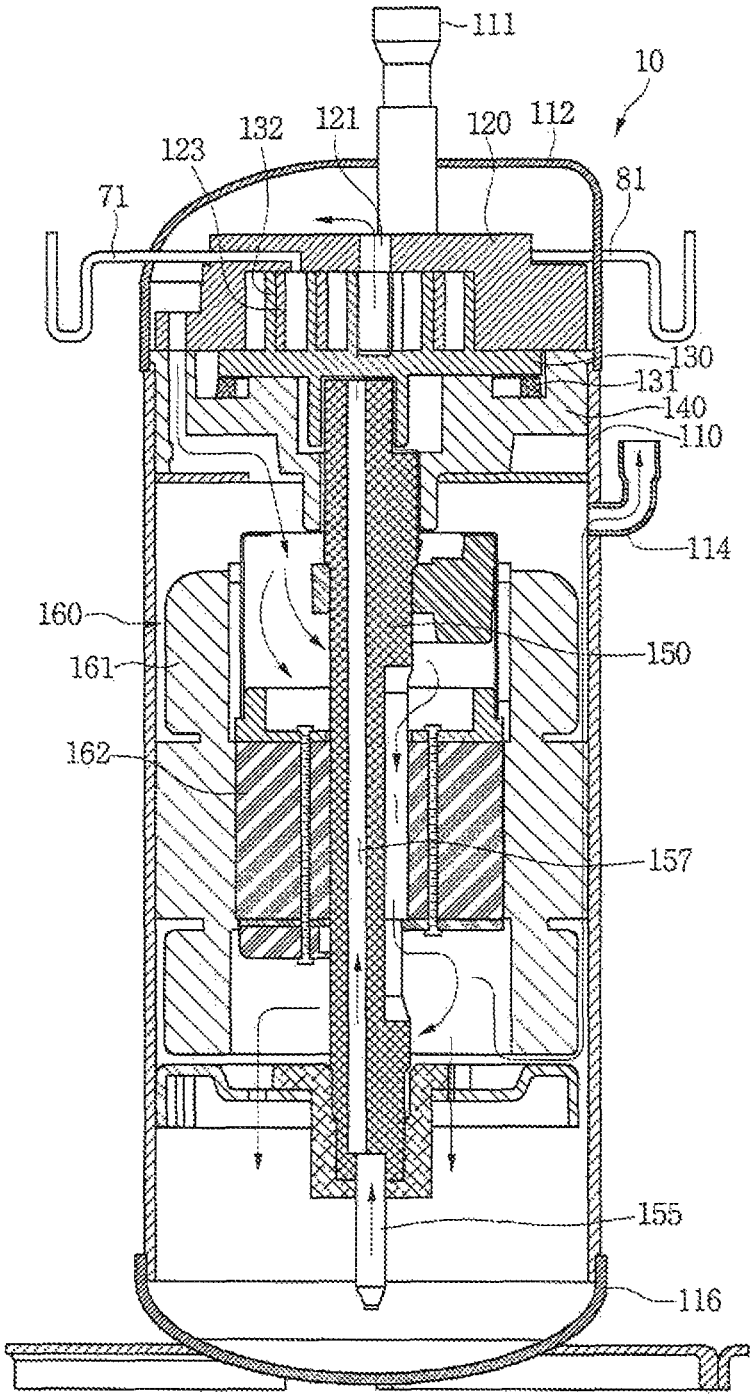
FIG. 3 is a cross-sectional view of a scroll compressor in accordance with an embodiment.
Figure 4:
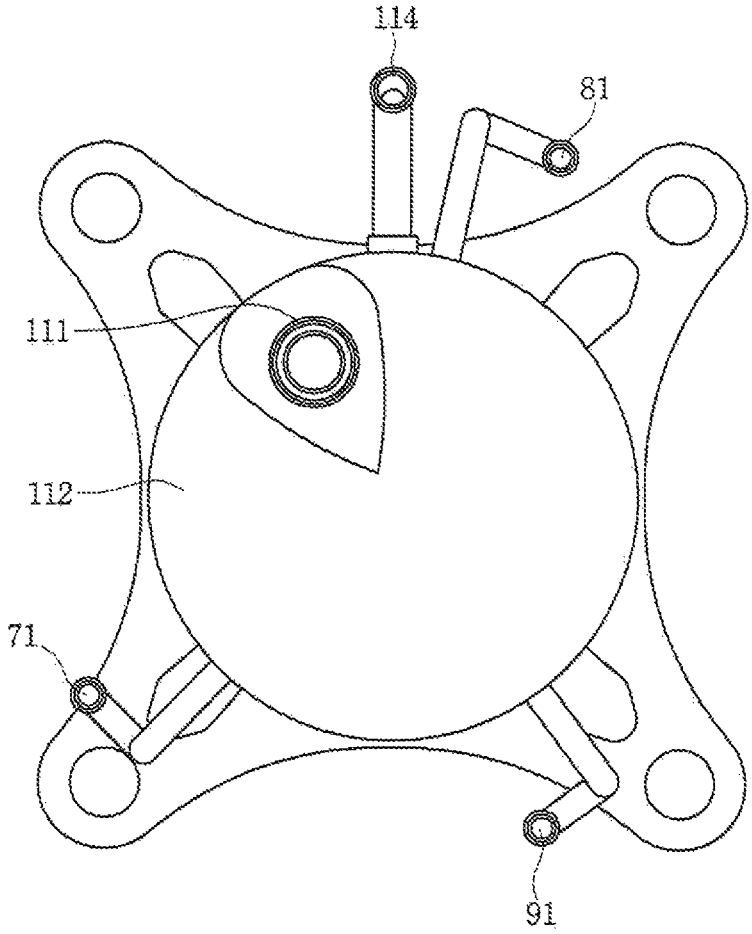
FIG. 4 is a top view of a discharge cover of the scroll compressor in accordance with an embodiment.
Figure 5:
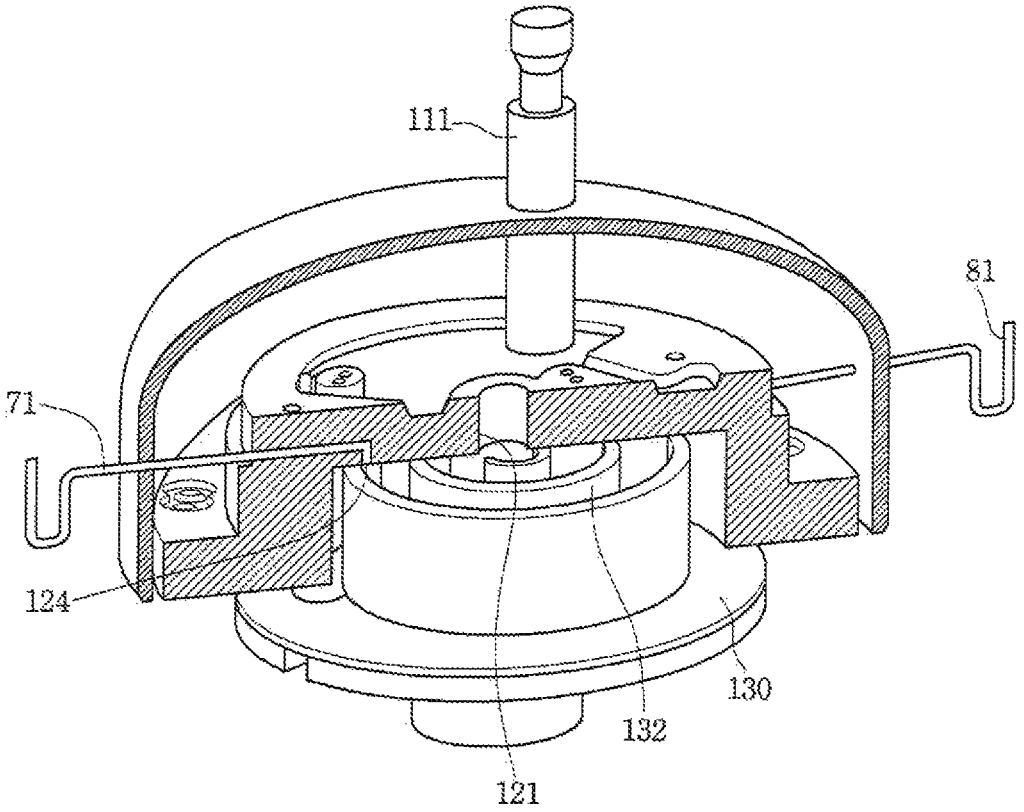
FIG. 5 is a partial cross-sectional view of the scroll compressor in accordance with an embodiment.

FIG. 3 is a cross-sectional view of a scroll compressor in accordance with an embodiment. FIG. 4 is a top view of a discharge cover of the scroll compressor in accordance with an embodiment. FIG. 5 is a partial cross-sectional view of the scroll compressor in accordance with an embodiment. Referring to FIGS. 3 and 4, the scroll compressor 10 according to an embodiment may include a housing 110, which may form an external appearance of the scroll compressor 10, a discharge cover 112, which may cover an upper side of the housing 110, and a base cover 116, which may be provided at a lower side of the housing 110 to store oil.

A refrigerant suction port 111, through which the refrigerant evaporated in the evaporator 25 may be suctioned into the compressor 10, may be coupled to the discharge cover 112. The refrigerant suction port 111 may pass through the discharge cover 112, extend downward, and may be coupled to a fixed scroll 120.

The scroll compressor 10 may include a motor 160, which may be accommodated in the housing 110 to generate a rotational force, a rotating shaft 150, which may rotatably pass through a center of the motor 160, a main frame 140, which may support an upper portion of the rotating shaft 150, and a compression device, which may be provided at an upper side of the main frame 140 to compress the refrigerant. The motor 160 may include a stator 161, which may be coupled into an inner circumferential surface of the housing 110, and a rotor 162, which may be rotated at an inside of the stator 161. The rotating shaft 150 may pass through a center of the rotor 162.

An oil supply path 157 may be formed off of a center of the rotating shaft 150 to be eccentric to one side of the rotating shaft 150, and the oil introduced into the oil supply path 157 may flow upward by a centrifugal force generated by rotation of the rotating shaft 150. An oil supply port 155 may be coupled to a lower side of the rotating shaft 150, and may enable the oil stored in the base cover 116 to flow to the oil supply path 157, while being integrally rotated with the rotating shaft 150.

The compression device may include the fixed scroll 120, which may be installed on an upper surface of the main frame 140 to communicate with the refrigerant suction port 111, an orbiting scroll 130, which may be orbitably supported by the upper surface of the main frame 140 to engage with the fixed scroll 120 and perform a compression operation, and an Oldham's ring 131, which may be installed between the orbiting scroll 130 and the main frame 140 to allow the orbiting scroll 130 to orbit while preventing rotation of the orbiting scroll 130. The orbiting scroll 130 may be coupled to the rotating shaft 150, and may receive a rotational force from the rotating shaft 150.

The fixed scroll 120 and the orbiting scroll 130 may have a phase difference of 180 degrees with respect to each other. The fixed scroll 120 may be provided with a spiral fixed scroll wrap 123, and the orbiting scroll 130 may be provided with a spiral orbiting scroll wrap 132. For convenience sake, the fixed scroll 120 may be referred to as a "first scroll", and the orbiting scroll 130 may be referred to as a "second scroll". The fixed scroll wrap 123 may be referred as a "first wrap", and the orbiting scroll wrap 132 may be referred to as a "second wrap".

A plurality of compression chambers may be formed by engagement between the fixed scroll wrap 123 and the orbiting scroll wrap 132. The refrigerant introduced into the plurality of compression chambers may be compressed to a high pressure by an orbiting motion of the orbiting scroll 130. A discharge hole 121, through which a refrigerant and oil fluid compressed to a high pressure may be discharged, may be formed at approximately a center of an upper portion of the fixed scroll 120.

While the plurality of compression chambers may be moved from an outside of the fixed scroll 120 toward a center of the discharge hole 121 by the orbiting motion of the orbiting scroll 130, respective volumes of the plurality of compression chambers may be reduced. The refrigerant may be compressed in the reduced volumes, and then may be discharged outside of the fixed scroll 120 through the discharge hole 121. The fluid discharged through the discharge hole 121 may be introduced into the housing 110, and then discharged through a discharge pipe 114. The discharge pipe 114 may be coupled to a side surface of the housing 110.

The first injection introduction port 71, which may inject the refrigerant flowing through the first injection path 70 into the compressor 10, the second injection introduction port 81, which may inject the refrigerant flowing through the second injection path 80 into the compressor 10, and the third injection introduction port 91, which may inject the refrigerant flowing through the third injection path 90 into the compressor 10 may be coupled to the compressor 10. The first to third injection introduction ports 71, 81, and 91 may be spaced apart from each other, and may be respectively coupled to the discharge cover 112.

The first injection introduction port 71 may pass through the discharge cover 112 at a first portion of the discharge cover 112, and may be inserted into the fixed scroll 120. The second injection introduction port 81 may pass through the discharge cover 112 at a second portion of the discharge cover 112, and may be inserted into the fixed scroll 120. The third injection introduction port 91 may pass through the discharge cover 112 at a third portion of the discharge cover 112, and may be inserted into the fixed scroll 120. The first to third injection introduction ports 71, 81 and 91 may be spaced apart from each other by predetermined angles based on a compression direction of the refrigerant or an opposite direction thereof.

A plurality of injection holes 124, 125 and 126 (referring to FIG. 6), which may inject the refrigerant into the plurality of compression chambers, may be formed at the fixed scroll 120. The plurality of injection holes 124, 125 and 126 may include a first injection hole 124, to which the first injection introduction port 71 may be coupled, a second injection hole 125, to which the second injection introduction port 81 may be coupled, and a third injection hole 126, to which the third injection introduction port 91 may be coupled. For example, the first injection introduction port 71, the second injection introduction port 81 and the third injection introduction port 91 may be inserted into the injection holes 124, 125 and 126, respectively.

While the orbiting scroll 130 orbits, the orbiting scroll wrap 132 may selectively open and close the first injection hole 124, the second injection hole 125 or the third injection hole 126. When the orbiting scroll wrap 132 is located at a first position, or when the rotating shaft 150 is rotated to a first angle, the refrigerant suctioned through the refrigerant suction port 111 may be introduced into an open space formed between the fixed scroll wrap 123 and the orbiting scroll wrap 132.

When the orbiting scroll 130 is continuously orbited, the open space may be covered by the orbiting scroll wrap 132, and thus, a suction chamber may be formed. The suction chamber may be a storage space in a state in which suctioning of the refrigerant is completed. When the orbiting scroll wrap 132 is orbited, the suction chamber may become a compression chamber.

When the orbiting scroll 130 is continuously orbited, the compression chamber may move from an external area of the fixed scroll 120 toward an internal area of the fixed scroll 120, and thus, a compression of the compression chamber may be performed. The compression chamber may be moved in a counterclockwise direction (referring to FIG. 6). The compression chamber may be moved closer to the discharge hole 121. When the compression chamber arrives at the discharge hole 121, the refrigerant may be discharged through the discharge hole 121. The forming of the compression chamber and the compressing of the refrigerant may be repeatedly performed.

In such a compressing process of the refrigerant, the refrigerant in the first to third injection paths 70, 80 and 90 may be selectively injected into the plurality of compression chambers through the first injection introduction port 71, the second injection introduction port 81, or the third injection introduction port 91. As the orbiting scroll 130 is orbited, the orbiting scroll wrap 132 may be moved to selectively open or close the first injection hole 124, the second injection hole 125, or the third injection hole 126. In a state in which the compression chamber is moved to one side of the first injection hole 124, the second injection hole 125, or the third injection hole 126, when the first injection hole 124, the second injection hole 125, or the third injection hole 126 is opened, the refrigerant may be injected into the corresponding compression chamber.

The refrigerant injected through the first injection introduction port 71 may have the first intermediate pressure, and may be injected into the compression chamber at or in a first stage of compression. The refrigerant injected through the second injection introduction port 81 may have the second intermediate pressure, which may be greater than the first intermediate pressure, and may be injected into the compression chamber at or in a second stage of compression.

The refrigerant injected through the third injection introduction port 91 may have the third intermediate pressure, which may be greater than the second intermediate pressure, and may be injected into the compression chamber at or in a third stage of compression. The first injection hole 124 may be formed at a position which is relatively distant from the discharge hole 121 in a radial direction. However, the second injection hole 125 may be formed at a position which may be relatively closer to the discharge hole 121 than the first injection hole 124 in the radial direction, and the third injection hole 126 may be formed at a position which may be relatively closer to the discharge hole 121 than the second injection hole 125 in the radial direction.

When the refrigerant is injected into the compression chamber, an opening degree of each of the first to third injection holes 124, 125, and 126, may be changed according to positions of the first to third injection introduction ports 71, 81, and 91, that is, positions of the first to third injection holes 124, 125, and 126. For example, a position of the compression chamber may be continuously moved according to the orbiting motion of the orbiting scroll wrap 132. The first to third injection holes 124, 125, and 126 may be in a completely closed state, an opened state of about 50%, or a completely opened state according to the positions of the first to third injection holes 124, 125, and 126 based on a specific position of the compression chamber due to a position of the orbiting scroll 130.

The positions of the first to third injection introduction ports 71, 81, and 91 may refer to an orbiting degree of the orbiting scroll 130 at which the injection introduction ports are opened, based on a point of time at which the suctioning of the refrigerant through the refrigerant suction port 111 is completed. The orbiting degree of the orbiting scroll 130 may correspond to a rotation degree of the rotating shaft 150. That is, according to one embodiment the positions of the first to third injection introduction ports 71, 81, and 91 or the positions of the first to third injection holes 124, 125, and 126 may be specified in connection with a compression degree of the refrigerant, at which the refrigerant may be injected through the first injection introduction port 71, the second injection introduction port 81, or the third injection introduction port 91, based on the point of time at which the refrigerant is suctioned through the refrigerant suction port 111.

Figure 6:
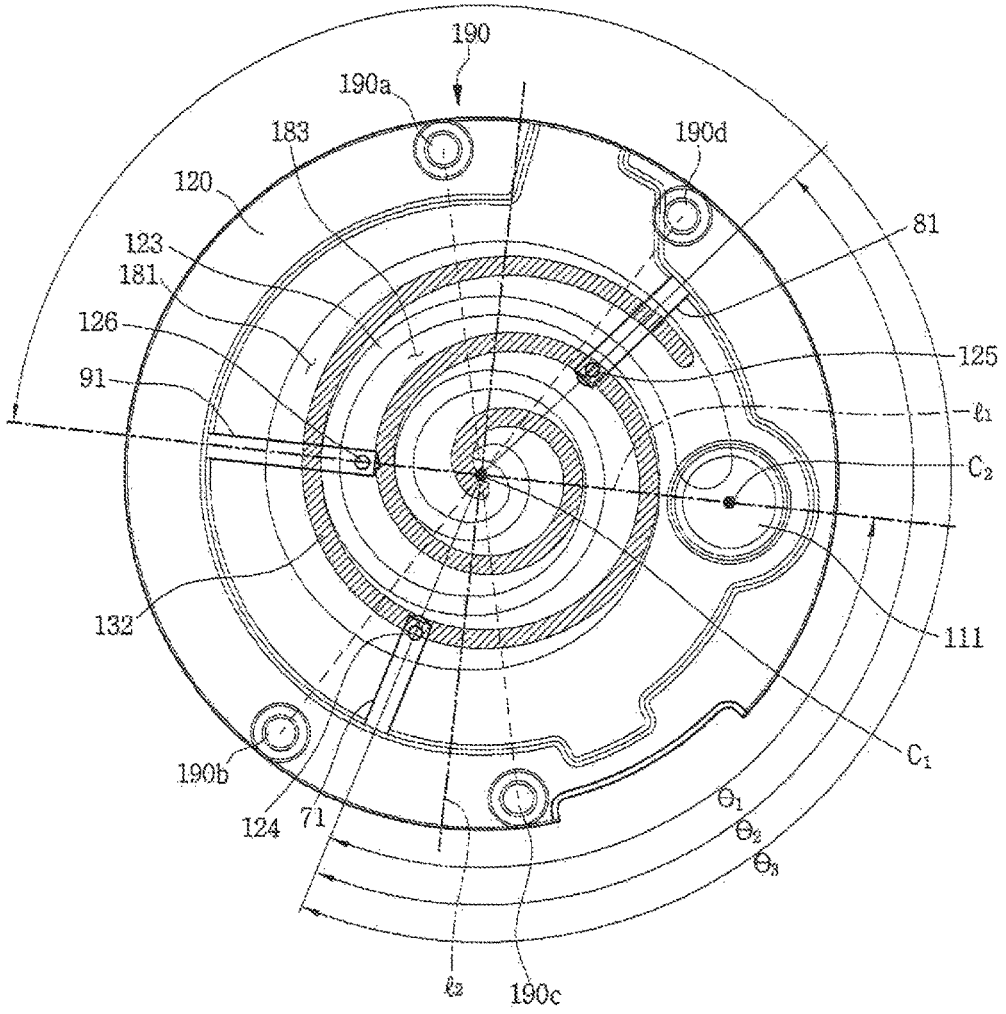
FIG. 6 is a view illustrating an arrangement of a scroll wrap and an injection introduction port in the scroll compressor in accordance with an embodiment.

FIG. 6 is a view illustrating an arrangement of the scroll wrap and the injection introduction port in the scroll compressor in accordance with an embodiment. Referring to FIG. 6, the plurality of compression chambers may be formed by engagement between the fixed scroll 120 and the orbiting scroll 130. Due to the orbiting motion of the orbiting scroll 130, the plurality of compression chambers may be moved from the external area of the fixed scroll 120 toward the internal area thereof, and thus, the volumes of the plurality of compression chambers may be reduced.

For example, the plurality of compression chambers may include a first compression chamber 181 and a second compression chamber 183. Due to the orbiting motion of the orbiting scroll wrap 132, the first compression chamber 181 and the second compression chamber 183 may be rotated in the counterclockwise direction, while having a phase difference of about 180°. The refrigerant in the second compression chamber 183 may have a higher pressure than the refrigerant in the first compression chamber 181.

When the orbiting scroll wrap 132 opens the first injection hole 124, the second injection hole 125, or the third injection hole 126 while the first and second compression chambers 181 and 183 are rotated, the refrigerant may be injected into the first compression chamber 181 or the second compression chamber 183. That is, as the first compression chamber 181 is rotated in the counterclockwise direction, when the first compression chamber 181 is located at one side of the first injection introduction port 71 and the first injection hole 124 is opened, the refrigerant may be injected into the first compression chamber 181 through the first injection hole 124.

The opening and closing of the first injection hole 124 may not be an ON/OFF concept, but rather, may mean that the first injection hole 124 may be gradually opened or closed according to the orbiting motion of the orbiting scroll wrap 132. After the refrigerant is injected into the first compression chamber 181, the compressing may be continuously performed, while the first compression chamber 181 may be moved in the counterclockwise direction.

As the second compression chamber 183 is rotated in the counterclockwise direction, when the second compression chamber 183 is located at one side of the second injection introduction port 81 and the second injection hole 125 is opened, the refrigerant may be injected into the second compression chamber 183 through the second injection hole 125. Similarly, the opening and closing of the second injection hole 125 may not be an ON/OFF concept, but rather, may mean that the second injection hole 125 may be gradually opened or closed according to the orbiting motion of the orbiting scroll wrap 132. After the refrigerant is injected into the second compression chamber 183, the compressing may be continuously performed, while the second compression chamber 183 is moved in the counterclockwise direction.

As the second compression chamber 183 is rotated in the counterclockwise direction, when the second compression chamber 183 is located at one side of the third injection introduction port 91 and the third injection hole 126 is opened, the refrigerant may be injected into the second compression chamber 183 through the third injection hole 126. As described above, the opening and closing of the third injection hole 126 may not be an ON/OFF concept, but rather, may mean that the third injection hole 126 may be gradually opened or closed according to the orbiting motion of the orbiting scroll wrap 132. After the refrigerant is injected through the third injection hole 126, the compressing may be continuously performed, while the second compression chamber 183 is moved in the counterclockwise direction. After the compressing is completed, the refrigerant may be discharged through the discharge hole 121.

The first injection introduction port 71 or the first injection hole 124 may be formed at a position at which the first injection hole 124 is opened before the suctioning of the refrigerant through the refrigerant suction port 111 is completed, that is, before the suction chamber is completed or closed. More specifically, a center or a center of gravity $C_1$ and a center $C_2$ corresponding to a center of the refrigerant suction port 111 may be formed at the fixed scroll 120. The center of gravity $C_1$ may refer to a position which indicates a center of gravity of the fixed scroll 120 or the main frame 140. For example, the center of gravity $C_1$ may correspond to a center of the discharge hole 121. For convenience of explanation, the center of gravity $C_1$ may be referred to as a "first center", and the center $C_2$ may be referred to as a "second center".

The fixed scroll 120 may include a plurality of fasteners 190, which may be coupled to the main frame 140. An even number of fasteners 190 may be provided. For example, as illustrated in FIG. 6, four fasteners 190 may be provided, and may include a first fastener 190*a*, a second fastener 190*b*, a third fastener 190*c*, and a fourth fastener, 190*d*, which may be spaced apart from each other. However, the number of the fasteners 190 is not limited thereto, and 6, 8 or 12 fasteners, for example, may be provided. The fastener 190*a* and the second fastener 190*b* may be located at a first side based on a second extension line $l_2$, and the third fastener 190*c* and the fourth fastener 190*d* may be located at a second side based on the second extension line $l_2$.

The fixed scroll 120 may be coupled to the main frame 140 through or by the plurality of fasteners 190, and thus, may be supported in a balanced state at an upper side of the main frame 140. The center of gravity $C_1$ of the fixed scroll 120 may be formed at a position at which a first line that connects two opposite fasteners intersects a second line that connects another two opposite fasteners. That is, the center of gravity $C_1$ may be formed at the position at which the first line that connects the first fastener 190*a* with the third fastener 190*c* intersects the second line that connects the second fastener 190*b* with the fourth fastener 190*d*. An imaginary line that extends from the first center $C_1$ toward the second center $C_2$ may be referred to as a first extension line and an imaginary line that extends from the first center $C_1$ in a direction perpendicular to the first extension line $l_1$ may be referred to as the second extension line $l_2$.

The first injection introduction port 71 or the first injection hole 124 may be formed at a position at which the first extension line $l_1$ is rotated clockwise about the first center $C_1$ at or by a first set angle $\theta_1$. The clockwise direction may be a direction opposite to a rotational direction of the compression chamber. That is, the rotational direction of the compression chamber may correspond to the counterclockwise direction.

For example, the first set angle $\theta_1$ may have a range of about 61° to about 101°. When the first injection introduction port 71 or the first injection hole 124 is located at the first set angle $\theta_1$, the opening of the first injection hole 124 may be started before the suctioning of the refrigerant is completed, that is, before the suction chamber is completed. Assuming that the point of time when the suctioning of the refrigerant through the refrigerant suction port 111 is completed is when a rotation angle of the rotating shaft 150 is about 0°, the opening of the first injection hole 124 may be started when the rotation angle of the rotating shaft 150 is about −50° to about −10°. That is, the range of the first set angle $\theta_1$ may correspond to about −50° to about −10° based on the rotation angle of the rotating shaft 150.

When the rotation angle of the rotating shaft 150 is about 0°, the suctioning of the refrigerant may be completed, and while the rotation angle is gradually increased to about 10° and then about 20°, the opening degree of the first injection hole 124 may be gradually increased, the injecting may be further performed, and the compressing of the refrigerant may be continuously performed. This compressing of the refrigerant may be the "first stage compression". That is, even though the first injection hole 124 may be opened before the suctioning of the refrigerant through the refrigerant suction port 111 is completed, and the injecting of the refrigerant is started, a point of time when the first injection hole 124 is completely opened and an amount of the injected refrigerant is increased may be when the suctioning of the refrigerant through the refrigerant suction port 111 is completed and then the compressing of the refrigerant may be performed.

The injection hole may be slowly opened at a predetermined interval of time, and the compressing of the refrigerant in the compression chamber may be performed even at a moment when the injecting is performed. Therefore, according to an embodiment, when the injection hole is opened too late, a pressure in the compression chamber may already be increased to more than a predetermined pressure; that is, internal resistance of the compression chamber may be in an increased state, and thus, a problem that the flow rate of the refrigerant to be injected is reduced due to a pressure difference may be prevented.

The second injection introduction port 81 or the second injection hole 125 may be formed at a position which may be rotated counterclockwise from the position of the first injection introduction port 71 or the first injection hole 124 at or by a second set angle $\theta_2$. For example, the second set angle $\theta_2$ may have a range of about 130° to about 150°. When the first injection introduction port 71 and the second injection introduction port 81 have a phase difference of about 180° or more with respect to each other, one compression chamber into which the refrigerant may be injected through the first injection introduction port 71 and the other compression chamber into which the refrigerant may be injected through the second injection introduction port 81 may be separated from each other.

That is, when the first injection introduction port 71 and the second injection introduction port 81 have a phase difference of about 180° or more, the first injection hole 124 may be covered by the orbiting scroll wrap 132 when the second injection hole 125 is opened. Therefore, the refrigerants having different intermediate pressures may be prevented from being simultaneously injected into the same compression chamber, that is, a phenomenon in which the injection holes are overlapped with each other may be prevented.

Figure 7:
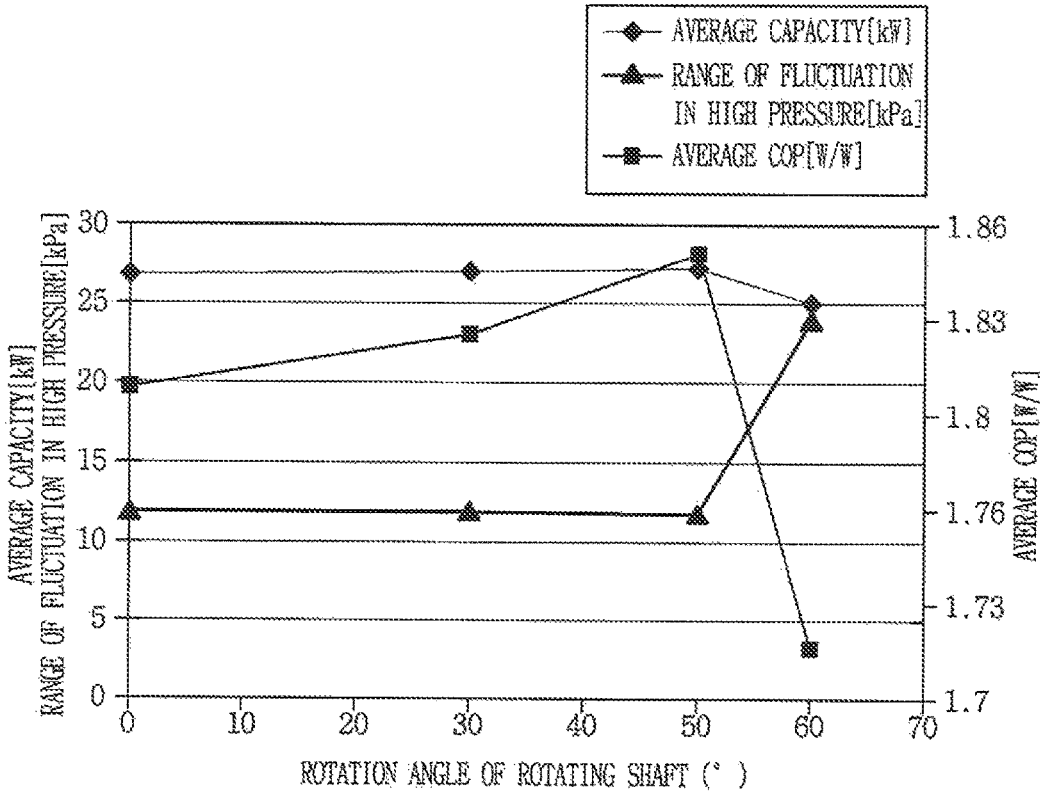
FIG. 7 is a graph illustrating a change in performance according to an angle of a rotating shaft while second and third injection introduction ports in accordance with an embodiment are simultaneously opened.
Figure 8:
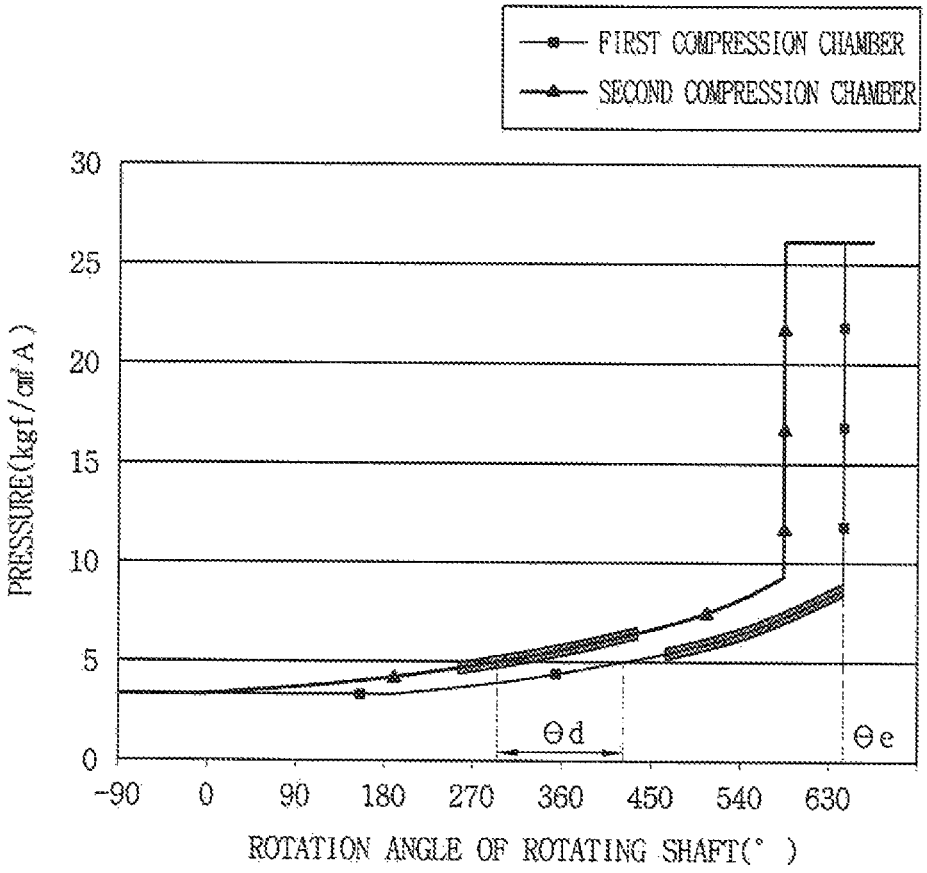
FIG. 8 is a graph illustrating a change in an internal pressure of each of first and second compression chambers according to a rotation angle of the rotating shaft in accordance with an embodiment.

In the case in which the injecting of the refrigerant is performed three times after the refrigerant is suctioned and before the refrigerant is discharged, if the first injection introduction port 71 and the second injection introduction port 81 have a phase difference of about 180° or more with respect to each other, a position of the third injection introduction port 91 may be formed too close to the discharge hole 121, and thus, there may be a problem that the refrigerant in the compression chamber may flow back to the third injection path 90 (referring to FIG. 8). Therefore, according to an embodiment the phenomenon in which the injection holes may be overlapped with each other may be reduced, thus, minimizing performance degradation of the compressor even when the phenomenon occurs. The rotation angle of the rotating shaft 150 may be limited to a maximum of about 50° for a period of time when the injection holes are overlapped with each other, that is, while the injection holes are overlapped with each other (referring to FIG. 7).

When the rotation angle of the rotating shaft 150 for a period of time when the injection holes are overlapped with each other is set to about 50°, the second set angle $\theta_2$ may be about 130°. However, when the rotation angle of the rotating shaft 150 to about 30°, the second set angle $\theta_2$ may be about 150°. In brief, when the opening of the second injection hole 125 is started, the first injection hole 124 may be in an opened state. When the rotating shaft 150 is further rotated by about 30° to about 50° after the second injection hole 125 is opened, the first injection hole 124 may be closed. That is, a phenomenon in which the first injection hole 124 is overlapped with the second injection hole 125 may occur.

While the refrigerant is injected through the second injection hole 125, the compressing in the compression chamber may be continuously performed. This compressing of the refrigerant may be the "second stage compression". The third injection introduction port 91 or the third injection hole 126 may be formed at a position which may be rotated counterclockwise from the position of the first injection introduction port 71 or the first injection hole 124 at or by a third set angle $\theta_3$. For example, the third set angle $\theta_3$ may have a range of about 260° to about 300°. The range of the third set angle $\theta_3$ may be a value which may be determined in consideration of the above-described overlapping phenomenon in which the injection holes may be overlapped with each other.

That is, when the opening of the third injection hole 126 is started, the second injection hole 125 may be in the opened state. When the rotating shaft 150 is further rotated by about 30° to about 50° after the third injection hole 126 is opened, the second injection hole 125 may be closed. That is, a phenomenon in which the second injection hole 125 is overlapped with the third injection hole 126 may occur. While the refrigerant is injected through the third injection hole 126, the compressing in the compression chamber may be continuously performed. This compressing of the refrigerant may be the "third stage compression".

After the injection of the refrigerant through the third injection hole 126 is completed, that is, after the third injection hole 126 is closed, the compressing may be further performed, while the compression chamber is rotated counterclockwise. This compressing of the refrigerant may be the "fourth stage compression". The compressed refrigerant of the fourth stage compression may be discharged outside of the fixed scroll 120 through the discharge hole 121.

FIG. 7 is a graph illustrating a change in performance according to an angle of the rotating shaft while second and third injection introduction ports in accordance with an embodiment are simultaneously opened. Referring to FIG. 7, with regard to the above-described overlapping phenomenon, the rotation angle of the rotating shaft 150, while the second and third injection holes 125 and 126 are simultaneously opened, is indicated at the horizontal axis. FIG. 7 illustrates an example based on the overlapping phenomenon between the second and third injection holes 125 and 126. However, the example may be equally applied to an overlapping phenomenon between the first and second injection holes 124 and 125.

Factors related to the performance of the compressor 10 or the air conditioner 1 are indicated at the vertical axis according to an angular change in the horizontal axis. More specifically, the factors indicated on the vertical axis may include an average capacity (KW) and an average coefficient of performance (COP) of the air conditioner 1, and a pressure of the refrigerant discharged from the compressor 10, that is, a range of fluctuation (Kpa) in high pressure.

In a process in which a refrigerant having a different intermediate pressure is injected into a compression chamber, the injected refrigerant may be mixed with an existing refrigerant in the compressor chamber, and thus, a change in pressure may occur. The range of fluctuation (Kpa) in high pressure may be a range of fluctuation in discharged high pressure, which may be varied by such a change in pressure. The range of fluctuation may be a difference between a maximum value of the discharged high pressure and a minimum value thereof. Until the rotation angle of the rotating shaft 150, that is, the angle at which the second and third injection holes 125 and 126 are simultaneously opened reaches about 50°, the average capacity and the range of fluctuation in high pressure of the air conditioner 1 may not be significantly changed, and the average COP may be slightly increased.

However, when the rotation angle of the rotating shaft 150 exceeds about 50°, for example, when the rotation angle of the rotating shaft 150 reaches about 60°, the average COP of the air conditioner 1 may be considerably reduced, and the average capacity may also be reduced. The range of fluctuation in high pressure may be considerably increased. When the range of fluctuation in high pressure is increased, operation stability and reliability of the compressor may be lowered, and the performance of the air conditioner may be degraded. Therefore, the rotation angle of the rotating shaft 150 may be maintained at about 50° or less.

The rotation angle of the rotating shaft 150 may be maintained at about 30° or more. More specifically, when the rotation angle of the rotating shaft 150 is maintained at about 30° or less, the phase difference between the two injection introduction ports may become closer to 180°, and the position of the third injection introduction port 91 may be located too close to the discharge pressure of the refrigerant, and thus, a problem that the injecting of the refrigerant through the third injection introduction port 91 may be restricted may occur.

Therefore, it may be necessary that the position of the third injection introduction port 91 be maintained at about 250° or less based on a point of time when the suctioning is completed (referring to FIG. 8). In consideration of such a fact, the rotation angle of the rotating shaft 150 may have a range of about 30° to about 50°, and thus, the second set angle $\theta_2$ may have a range of about 130° to about 150°, and the third set angle $\theta_3$ may have a range of about 260° to about 300°.

FIG. 8 is a graph illustrating a change in an internal pressure of each of the first and second compression chambers according to the rotation angle of the rotating shaft in accordance with an embodiment. As evident in FIG. 8, the pressure in each of the first and second compression chambers 181 and 183 may be changed according to the rotation angle of the rotating shaft 150 in accordance with an embodiment.

When the rotation angle of the rotating shaft 150 is about 0°, a point of time when the suctioning of the refrigerant is completed and the suction chamber is completed may be defined. As the rotating shaft 150 begins to rotate, the internal pressure of each of the first and second compression chambers 181 and 183 may be slowly increased, while the first and second compression chambers 181 and 183 may be moved. The compressing may be performed, while the first compression chamber 181 and the second compression chamber 183 are moved with a preset or predetermined phase difference $\theta_d$. For example, the phase difference θd may be about 180°.

When the rotating shaft 150 rotates to a preset or predetermined angle, for example, when the rotation angle is θe (about 630°), the internal pressure of the compression chamber may be sharply increased. Until the refrigerant is suctioned through the refrigerant suction port 111 and then discharged through the discharge hole 121, the rotating shaft 150 may make about 3 rotations (about 1080°).

When the third injection introduction port 91 is located at a position at which the internal pressure of the compression chamber is sharply increased, the internal pressure (the internal resistance) of the compression chamber may be greater than the pressure of the injected refrigerant, and thus, the injecting of the refrigerant through the third injection hole 126 may be restricted, and the refrigerant may flow back from the compression chamber into the third injection introduction port 91. As such, the third injection introduction port 91 may be formed at a position before the internal pressure of the compression is sharply increased, for example, a position of about 250° or less in a compressing direction of the refrigerant based on a point of time when the suctioning of the refrigerant is completed.

Referring to FIG. 8, an area which is indicated by a thick line in the graph illustrating the change in the pressure of each of the first and second compression chambers may show a section in which the third injection hole 126 is opened to the first compression chamber 181 or the second compression chamber 183, when the third injection introduction port 91 is located at the position of about 250°. A last portion of the section in which the third injection hole 126 is opened to the first compression chamber 181 may correspond to the rotation angle $\theta_e$ of the rotating shaft in which the pressure of the first compression chamber 181 is sharply increased. Therefore, when the third injection introduction port 91 is located at a position of about 250° or more, the injecting of the refrigerant may be performed even after the point of time when the internal pressure of the first compression chamber 181 is sharply increased. As such, the third injection introduction port 91 may be formed at a position of about 250° or less.

When the third injection introduction port 91 is formed at the position of about 250°, the third set angle $\theta_3$ may correspond to about 300°. When the third set angle $\theta_3$ is about 260°, the position of the third injection introduction port 91 may correspond to a position according to a condition at which the rotation angle of the rotating shaft 150 is maintained at about 50° or less in consideration of the overlapping phenomenon.

As described above, an embodiments disclosed herein may increase the flow rate of the injected refrigerant by performing the injecting of the refrigerant through the three injection introduction ports, and also may optimize the positions of the three injection introduction ports, and thus, may improve the performance of the compressor and the air conditioner.

According to embodiments disclosed herein, as the refrigerant may be injected to positions of the scroll compressor different from each other, the flow rate of the refrigerant in the system may be increased, and thus, the cooling and warming performance may be enhanced. In particular, as the three injection introduction ports may be formed at the scroll compressor so that the refrigerant may be injected three times until the refrigerant is suctioned and then discharged, the flow rate of the refrigerant may be increased. As the refrigerant having the intermediate pressure may be injected into the compressor, power necessary to compress the refrigerant in the compressor may be reduced, and thus, cooling and warming efficiency may be increased.

Further, before the refrigerant is completely suctioned into the compressor through the refrigerant suction port, the first injection introduction port may begin opening, and the injecting may be performed at the first stage compression of the refrigerant in the compressor, and thus, the pressure (the intermediate pressure) of the injected refrigerant may be reduced, and the flow rate of the injected refrigerant may also be increased. That is, at a point of time when the suctioning of the refrigerant is completed, the opening degree of the injection hole may be in an opened state to a certain level, and then the opening degree of the injection hole may be increased while the compressing is performed, and thus, the flow rate of the injected refrigerant may be increased.

Further, as the first injection introduction port and the second injection introduction port may be provided to have a first phase difference, and the first injection introduction port and the third injection introduction port may be provided to have a second phase difference, an opening and closing time of the first to third injection introduction ports may be optimized, and thus, the injecting and the compressing of the refrigerant may be effectively performed. As the second and third injection introduction ports may be formed at positions which may reduce a time when the second and third injection introduction ports are simultaneously opened, reliability in an operation of the compressor may be improved. That is, the injected refrigerants having different pressures from each other may be introduced into the same compressor chamber for a long period of time, and thus, the discharge high pressure of the compressor may be prevented from being changed considerably.

Furthermore, as the third injection introduction port may be located at an angle which may be set based on a point of time when the suctioning in the compressor is completed, the injection introduction port may be prevented from being opened at a position at which the internal pressure of the compressor is sharply increased. Accordingly, due to the pressure difference, the refrigerant in the compressor may be prevented from flowing back to the injection path.

A scroll compressor which is able to increase a flow rate of a refrigerant injected into the compressor, and an air conditioner including the same are disclosed herein. According to an embodiment, a scroll compressor is provided that may include a motor configured to generate a driving force; a rotating shaft configured to rotatably pass through the motor; a main frame configured to support an upper portion of the rotating shaft; a fixed scroll coupled to the main frame and having a first wrap; an orbiting scroll disposed or provided to perform an orbiting motion with respect to the fixed scroll and having a second wrap, which and having a rotatable compression chamber between the first wrap and the second wrap; a suction part or port configured to enable a first refrigerant to be suctioned into the compression chamber; a first introduction part or port provided at a first side of the fixed scroll and configured to inject the first refrigerant into the compression chamber; a second introduction part or port provided at a second side of the fixed scroll and configured to inject a second refrigerant having a different pressure different from that of the refrigerant injected into the first introduction part into the compression chamber; and a third introduction part or port may be provided at a third side of the fixed scroll and configured to inject a third refrigerant having a different pressure different from those of the refrigerants injected into the first and second introduction parts into the compression chamber. The first introduction part may be provided at a position at which injecting of the refrigerant through the first introduction part may be able to be performed before suctioning of the refrigerant through the suction part is completed.

The first introduction part may be provided at a position at which an extension line that connects a center of the fixed scroll with a center of the suction part may be rotated at a first set angle $\theta_1$ in a direction opposite to a rotational direction of the compression chamber. The first set angle ($\theta_1$) may have a range of about 61° to about 101°.

The second introduction part may be provided at a position which may be rotated at a second set angle θ2 from a position of the first introduction part in a rotational direction of the compression chamber. The second set angle θ2 may have a range of about 130° to about 150°.

The third introduction part may be provided at a position which may be rotated at a third set angle $\theta_3$ from a position of the first introduction part in a rotational direction of the compression chamber. The third set angle $\theta_3$ may have a range of about 260° to about 300°. The fixed scroll may include a plurality of fastening parts or fasteners coupled to the main frame, and a center of the fixed scroll may be formed at a position at that an imaginary line that connects two opposite fastening parts among the plurality of fastening parts intersects an imaginary line that connects another two opposite fastening parts.

When a rotation angle of the rotating shaft at a point of time when the suctioning of the refrigerant through the suction part is completed is about 0°, opening of the first introduction part may be started, when the rotation angle of the rotating shaft is about −50° to about −10°, a discharge hole, through which the compressed refrigerant may be discharged, may be formed at the fixed scroll, and the center of the fixed scroll may be a center of the discharge hole. The compression chamber may include a first compression chamber and a second compression chamber, which may have a set phase difference θd.

According to another embodiment, a scroll compressor is provided that may include a fixed scroll having a first wrap; an orbiting scroll provided to have a phase difference with respect to the fixed scroll and having a second wrap which forms a rotatable compression chamber between the first wrap and the second wrap; a suction part or port configured to enable a refrigerant to be suctioned into the compression chamber; a first introduction part or port provided at a first side of the fixed scroll and configured to inject the refrigerant into the compression chamber; a second introduction part or port provided at a second side of the fixed scroll to inject the refrigerant into the compression chamber, and may be provided at a position which may be rotated at a second set angle $\theta_2$ from a position of the first introduction part in a rotational direction of the compression chamber; and a third introduction part or port provided at a third side of the fixed scroll to inject the refrigerant into the compression chamber, and provided at a position which may be rotated at a third set angle $\theta_3$ from the position of the first introduction part in the rotational direction of the compression chamber.

The first introduction part may be provided at a position at which an extension line that connects a center of the fixed scroll with a center of the suction part may be rotated at a first set angle $\theta_1$ in a direction opposite to the rotational direction of the compression chamber. The first set angle $\theta_1$ may have a range of about 61° to about 101°. The second set angle $\theta_2$ may have a range of about 130° to about 150°. The third set angle $\theta_3$ may have a range of about 260° to about 300°. According to still another embodiment, an air conditioner including a scroll compressor is provided.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a housing;

a discharge cover configured to cover an upper side of the housing;

a motor configured to generate a drive force;

a rotatable shaft configured to rotatably pass through the motor, a main frame configured to support an upper portion of the rotatable shaft;

a fixed scroll coupled to the main frame and having a first wrap;

an orbiting scroll that performs an orbiting motion with respect to the fixed scroll and having a second wrap that forms a plurality of compression chambers between the first wrap and the second wrap;

a suction port configured to enable a main refrigerant to be suctioned into the plurality of compression chambers and coupled to the discharge cover;

a first introduction port provided at a first portion of the fixed scroll and configured to inject a first branched refrigerant into the plurality of compression chambers;

a second introduction port provided at a second portion of the fixed scroll and configured to inject a second branched refrigerant having a pressure different from a pressure of the first branched refrigerant into the plurality of compression chambers; and a third introduction port provided at a third portion of the fixed scroll and configured to inject a third branched refrigerant having a pressure different from the pressure of the first branched refrigerant and the second branched refrigerant into the plurality of compression chambers, wherein the fixed scroll includes a plurality of injection holes that are opened and closed as the orbiting scroll is orbited, the plurality of injection holes including:

a first injection hole coupled to the first injection introduction port;

a second injection hole coupled to the second injection introduction port; and a third injection hole coupled to the third injection introduction port, and wherein at least two of the first injection hole, the second injection hole, or the third injection hole are opened simultaneously during a rotational angle of 50 degrees or less of the rotatable shaft.

2. The scroll compressor according to claim 1, wherein the first introduction port is provided at a position at which injecting of the first branched refrigerant through the first introduction port is performed before suctioning of the main refrigerant through the suction port is completed.

3. The scroll compressor according to claim 2, wherein the first introduction port is provided at a position at which an extension line that connects a center of the fixed scroll with a center of the suction port having a circular shape is rotated to a first predetermined angle in a direction opposite to a rotational direction of the plurality of compression chambers.

4. The scroll compressor according to claim 3, wherein the first predetermined angle has a range of 610 to 1010.

5. The scroll compressor according to claim 3, wherein the fixed scroll includes a plurality of fasteners coupled to the main frame, and wherein the center of the fixed scroll is formed at a position at which an imaginary line that connects two opposite fasteners among the plurality of fasteners intersects an imaginary line that connects another two opposite fasteners.

6. The scroll compressor according to claim 2, wherein the second introduction port is provided at a position which is located at a second predetermined angle from a position of the first introduction port in a rotational direction of the plurality of compression chambers.

7. The scroll compressor according to claim 6, wherein the second predetermined angle has a range of 130° to 150°.

8. The scroll compressor according to claim 2, wherein the third introduction port is provided at a position which is located at a third predetermined angle from a position of the first introduction port in a rotational direction of the plurality of compression chambers.

9. The scroll compressor according to claim 8, wherein the third predetermined angle has a range of 260° to 300°.

10. The scroll compressor according to claim 2, wherein a rotational angle of the rotatable shaft at a point of time when the suctioning of the main refrigerant through the suction port is completed is defined as about 0°, and wherein opening of the first introduction port is started when the rotational angle of the rotatable shaft is −50° to −10°.

11. The scroll compressor according to claim 2, wherein a discharge hole, through which compressed refrigerant is discharged, is formed at the fixed scroll, and the center of the fixed scroll is a center of the discharge hole.

12. The scroll compressor according to claim 2, wherein the plurality of compression chambers includes a first compression chamber and a second compression chamber, which have a set phase difference from each other.

13. An air conditioner including the scroll compressor according to claim 1.

14. A scroll compressor, comprising:

a fixed scroll having a first wrap;

an orbiting scroll having a phase difference with respect to the fixed scroll and having a second wrap which forms a plurality of compression chambers between the first wrap and the second wrap;

a suction port configured to enable a main refrigerant to be suctioned into the plurality of compression chambers;

a first introduction port provided as a single port at a first portion of the fixed scroll and configured to inject a first branched refrigerant into the plurality of compression chambers;

a second introduction port provided as a single port at a second portion of the fixed scroll to inject a second branched refrigerant into the plurality of compression chambers, and provided at a position which is rotated to a first predetermined angle from a position of the first introduction port in a rotational direction of the plurality of compression chambers;

a third introduction port provided as a single port at a third portion of the fixed scroll to inject a third branched refrigerant into the plurality of compression chambers, and provided at a position which is rotated to a second predetermined angle from the position of the first introduction port in the rotational direction of the plurality of compression chambers; and a plurality of injection holes formed in the fixed scroll and respectively opened and closed in accordance with the orbiting motion of the orbiting scroll, wherein the plurality of injection holes include:

a first injection hole coupled to the first injection introduction port;

a second injection hole coupled to the second injection introduction port; and a third injection hole coupled to the third injection introduction port, and wherein the second injection hole and the third injection hole are opened simultaneously during a rotational angle of 50 degrees or less of a rotatable shaft.

15. The scroll compressor according to claim 14, wherein the first introduction port is provided at a position at which an extension line that connects a center of the fixed scroll with a center of the suction port having a circular shape is rotated to a third predetermined angle in a direction opposite to the rotational direction of the plurality of compression chambers.

16. The scroll compressor according to claim 15, wherein the third predetermined angle has a range of 61 to 1010.

17. The scroll compressor according to claim 14, wherein the first predetermined angle has a range of 130° to 150°.

18. The scroll compressor according to claim 14, wherein the second predetermined angle has a range of 260° to 300°.

19. An air conditioner including the scroll compressor according to claim 14.

20. A scroll compressor, comprising:

a motor configured to generate a drive force;

a rotatable shaft configured to rotatably pass through the motor, a main frame configured to support an upper portion of the rotatable shaft, a first scroll coupled to the main frame and having a first wrap;

a second scroll that performs an orbiting motion with respect to the fixed scroll and having a second wrap that forms a plurality of compression chambers between the first wrap and the second wrap;

a suction port configured to enable a main refrigerant to be suctioned into the plurality of compression chambers;

a plurality of introduction ports provided at different circumferential portions of the first scroll, wherein each of the plurality of introduction ports injects a branched refrigerant having a different pressure; and three injection holes formed in the fixed scroll to inject the refrigerant into the plurality of compression chambers and coupled to the plurality of injection introduction ports, wherein the three injection holes are spaced apart from each other by 50 degrees or more and 180 degrees or less in a circumferential direction.

21. The scroll compressor according to claim 20, wherein the plurality of introduction ports includes a first introduction port that injects a first branched refrigerant at a first pressure into a first injection hole, a second introduction port that injects a second branched refrigerant at a second pressure into a second injection hole, and a third introduction port that injects a third branched refrigerant at a third pressure into a third injection hole, and wherein the third pressure is higher than the second pressure, and the second pressure is higher than the first pressure.

22. The scroll compressor according to claim 21, wherein the first introduction port is provided at a position at which injecting of the first branched refrigerant through the first introduction port is performed before suctioning of the main refrigerant through the suction port is completed.

23. The scroll compressor according to claim 21, wherein a rotational angle of the rotatable shaft at a point of time when the suctioning of the main refrigerant through the suction port is completed is defined as about 0°, and wherein opening of the first introduction port is started when the rotational angle of the rotatable shaft is −50° to −10°.

24. The scroll compressor according to claim 20, wherein a discharge hole, through which compressed refrigerant is discharged, is formed at the fixed scroll, and a center of the fixed scroll is a center of the discharge hole.

25. The scroll compressor according to claim 20, wherein the plurality of compression chambers includes a first compression chamber and a second compression chamber, which have a set phase difference from each other.

26. An air conditioner including the scroll compressor according to claim 20.

* * * * *